US006022146A

United States Patent [19]

Bull

[11] Patent Number: 6,022,146

[45] Date of Patent: Feb. 8, 2000

[54] SOFT BAG EXPANDERS

[75] Inventor: Jan E. Bull, Colorado Springs, Colo.

[73] Assignee: Monarch Luggage Co., Inc., Brooklyn, N.Y.

[21] Appl. No.: 09/085,477

[22] Filed: May 27, 1998

[51] Int. Cl.[7] ..... A45C 7/00

[52] U.S. Cl. ..... 383/127

[58] Field of Search ..... 383/127, 35, 33, 383/34

[56] References Cited

U.S. PATENT DOCUMENTS

| | | | |
|---|---|---|---|
| D. 316,633 | 5/1991 | Markowitz . | |
| D. 346,064 | 4/1994 | Markowitz . | |
| D. 362,113 | 9/1995 | Markowitz . | |
| 1,745,947 | 2/1930 | Mustin . | |
| 2,798,579 | 7/1957 | Fox . | |
| 2,930,557 | 3/1960 | Richards . | |
| 3,447,648 | 6/1969 | Schwennicke . | |
| 3,902,541 | 9/1975 | Wardwell . | |
| 3,934,803 | 1/1976 | Paulus, Jr. . | |
| 4,077,451 | 3/1978 | Zoland . | |
| 4,141,399 | 2/1979 | Zoland . | |
| 4,142,564 | 3/1979 | Zoland . | |
| 4,395,845 | 8/1983 | Markowitz . | |
| 4,434,894 | 3/1984 | Lee . | |
| 4,993,846 | 2/1991 | Diamond . | |
| 5,179,600 | 1/1993 | Bailey et al. | 383/127 |
| 5,322,362 | 6/1994 | Smith | 383/127 |
| 5,341,532 | 8/1994 | Markowitz . | |
| 5,499,874 | 3/1996 | Tang | 383/127 |

FOREIGN PATENT DOCUMENTS

| | | | |
|---|---|---|---|
| 2610298 | 8/1988 | France | 383/127 |

*Primary Examiner*—Jes F. Pascua
*Attorney, Agent, or Firm*—Stroock & Stroock & Lavan LLP

[57] ABSTRACT

A soft bag expander comprising a bottom panel having at least two bottom fold lines along opposite sides thereof; a first inner side panel and a second inner side panel affixed to said bottom panel along a first fold line and second fold line and each inner side panel being rotatable about the fold line to extend upwards from the bottom panel; a top panel having at least two top panel fold lines along opposite sides thereof; a first outer side panel and a second outer side panel, each outer side panel being disposed on a respective inner side panel, a respective middle fold line transversing each outer side panel formed parallel to the bottom fold line, each outer side panel extending from a respective top panel fold line to a position below each respective fold line; a resilient member resiliently joining a respective one of the outer side panels to a respective inner side panel to bias the respective side panels from a closed position into an open position, the inner side panels being positioned adjacent to the bottom panel in the closed position and the inner side panel extending upwards from the bottom panel in the open position. Other forms of the invention use side panels affixed to both the bottom and top panels with a separate inner panel biased to the to the side panels. Yet another embodiment of the invention uses pairs of hooks and holes or slots to which the resilient member is strung.

16 Claims, 5 Drawing Sheets

2
2
100
212
204
200
202
100
214
208
210

200
200

5
5
100
214
208
140
150b
160b
132b
166b
166b
170b
212
134b
168a
120b
130b
206
150a
132a
130a
160a
166a
210
170a
134a
168b
120a
110
202

SOFT BAG EXPANDERS

BACKGROUND OF THE INVENTION

The present invention relates to a device used for expanding articles such as soft bags at the point of sale and in particular to collapsible soft bag expanders.

Retail stores such as K Mart or Wal-mart often display soft bags, such as tote bags, luggage or the like. It is desirable to display the bags in an expanded form in order to catch the attention of the ultimate consumer. Many of these bags are manufactured overseas and then imported into the United States. Soft bags are not generally shipped in the expanded condition because shipping costs tend to be very high for bulky materials as a result of the wasted space in an expanded bag. Alternatively, labor costs for expanding the bags at the point of sale can also be expensive. Therefore, it is advantageous to have a bag expander inserted into the soft bag at the point of manufacture, compress the bag and expander and ship the bag in its compressed form. Then when the bags reach the point of sale the retail seller need only remove force from the bag and the expander inside will return to its expanded shape to puff the bag up into its fully expanded form.

Such bag expanders are known in the art from U.S. Pat. Nos. 3,934,803, 4,077,451, 4,141,399 and 4,993,846. Each of these patents teach a device for expanding soft bags using various mechanisms. The concept of using panels and springs for expanding luggage using the insert is well known in the prior art and the use of foldable panels for expansion to separate the layers and keep them under tension is also well known in the art. The prior art expanders have been satisfactory however, they suffer from the disadvantage that they only provide stable support at a single position within the bag and do not provide support throughout the bag.

SUMMARY OF THE INVENTION

A soft bag expander is provided having a bottom panel having at least two bottom fold lines along opposite sides thereof. A first inner side panel and a second inner side panel are affixed to said bottom panel along the first fold line and second fold line. Each inner side panel being rotatable about the fold line to extend upwards from the bottom panel. A top panel includes at least two top panel fold lines along opposite sides thereof. A first outer side panel and a second outer side panel are each disposed on a respective inner side panel, a respective middle fold line transversing each outer side panel formed parallel to the bottom fold line, each outer side panel extending from a respective top panel fold line to a position below each respective fold line. A resilient member resiliently joins a respective one of the outer side panels to a respective inner side panel to bias the respective side panels from a closed position into an open position, the inner side panels being positioned adjacent to the bottom panel in the closed position and the inner side panel extending upwards from the bottom panel in the open position. Other forms of the invention use side panels affixed to both the bottom and top panels with a separate inner panel biased to the to the side panels. Yet another embodiment of the invention uses pairs of hooks and holes or slots to which the resilient member is strung.

Accordingly, it is an object of the invention to provide an improved expander. Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a better understanding of the present invention, reference may be had to the accompanying drawings in which.

DETAILED DESCRIPTION OF THE INVENTION

Figure 1:
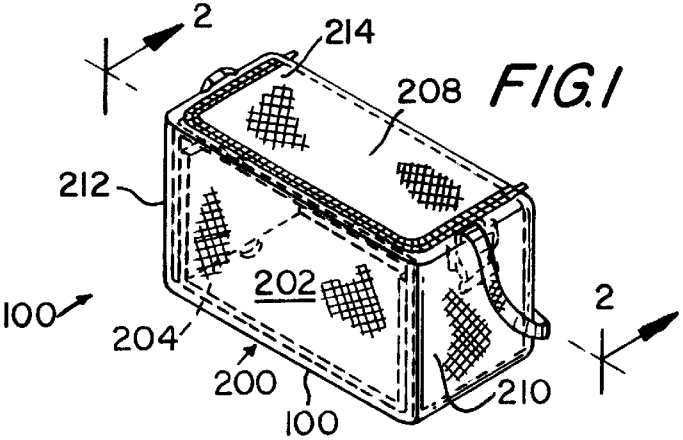
FIG. 1 is a perspective view of a soft bag containing an expander in accordance with the first embodiment of the invention.

Reference is made to FIGS. 1–7, which show a soft bag 200 and an expander 100, constructed in accordance with the invention, in the soft bag 200. Soft bag 200 may come in a number of shapes and sizes, however, they can generally be considered to form a six sided enclosure. By way of example, soft bag 200 includes a bottom 202, opposed sides 204, 206, a top 208 and side panels 210, 212. Top 208 includes a zipper 214 for providing access within.

Expander 100 is disposed within soft bag 200 and includes a bottom panel 110 having at least two bottom fold lines 120*a* and 120*b* along opposite sides thereof. A first inner side panel 130*a* and a second inner side panel 130*b* are affixed to said bottom panel 110 along the first fold line 120*a* and the second fold line 120*b*. Each inner side panel 130*a*, 130*b* is pivotable about the fold lines 120*a* and 120*b* to extend away from the bottom panel 110 at an angle. Each side panel 130*a*, 130*b* formed with a respective hook portion 132*a*, 132*b* formed on the edge of side panel 130*a*, 130*b* away from fold lines 120*a*, 120*b*. A respective slit 134*a*, 134*b* is formed along each fold line 120*a*, 120*b*.

A top panel 140 has at least two top panel fold lines 150*a* and 150*b* along opposite sides thereof. A first outer side panel 160*a* and a second outer side panel 160*b* extend from and are pivotable about a respective fold line 150*a*, 150*b*. Panels 160*a*, 160*b* extend away from top panel 140. Each side panel 160*a*, 160*b* is provided with a respective cut out portion 162*a*, 162*b*. A respective hook 164*a*, 164*b* is disposed within opening 162*a*, 162*b* and extends from a respective side panel 160*a*, 160*b*. A second opening 166*a*, 166*b* is formed in a respective side panel 160*a*, 160*b* below respective hooks 164*a*, 164*b*. An arrow shaped tab 168*a*, 168*b* extends from a respective side panel 160*a*, 160*b* and is dimension to be received through slots 134*a*, 134*b* but to prevent tab 168*a*, 168*b* from sliding back through slits 134*a*, 134*b*.

A respective middle fold line 170*a*, 170*b* extends along each outer side panel 160*a*, 160*b* formed substantially parallel to bottom fold line 120, and bottom panel 110 and top panel 140 are relatively positioned to form an open sided enclosure (FIGS. 2–7). A first outer side panel 160*a* and second outer side panel 160*b* are each disposed adjacent a respective inner side panel 130*a*, 130*b*.

Figure 7:
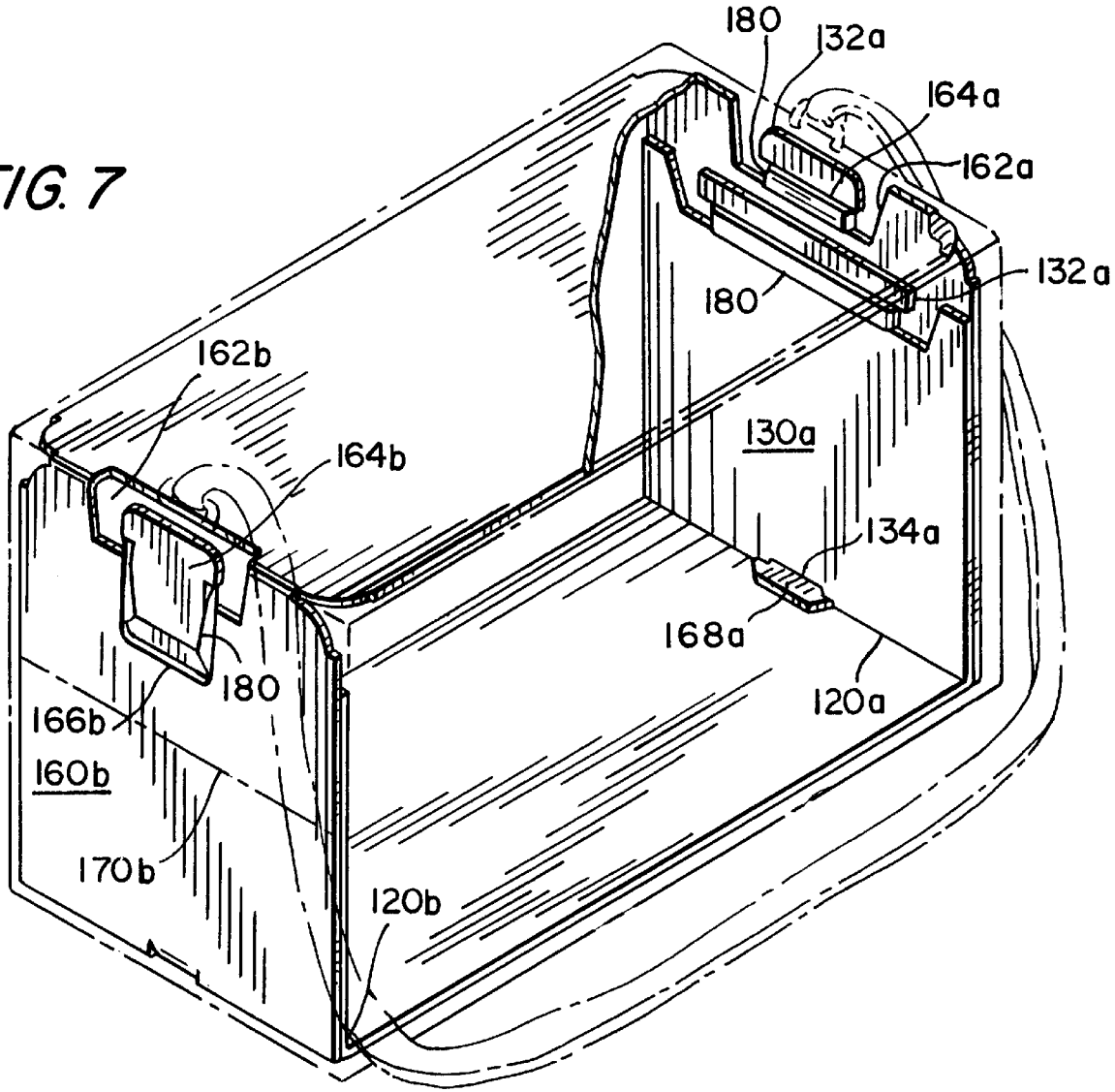
FIG. 7 is a perspective view of a soft bag containing an expander in accordance with the first embodiment of the invention.
Figures 8, 9:
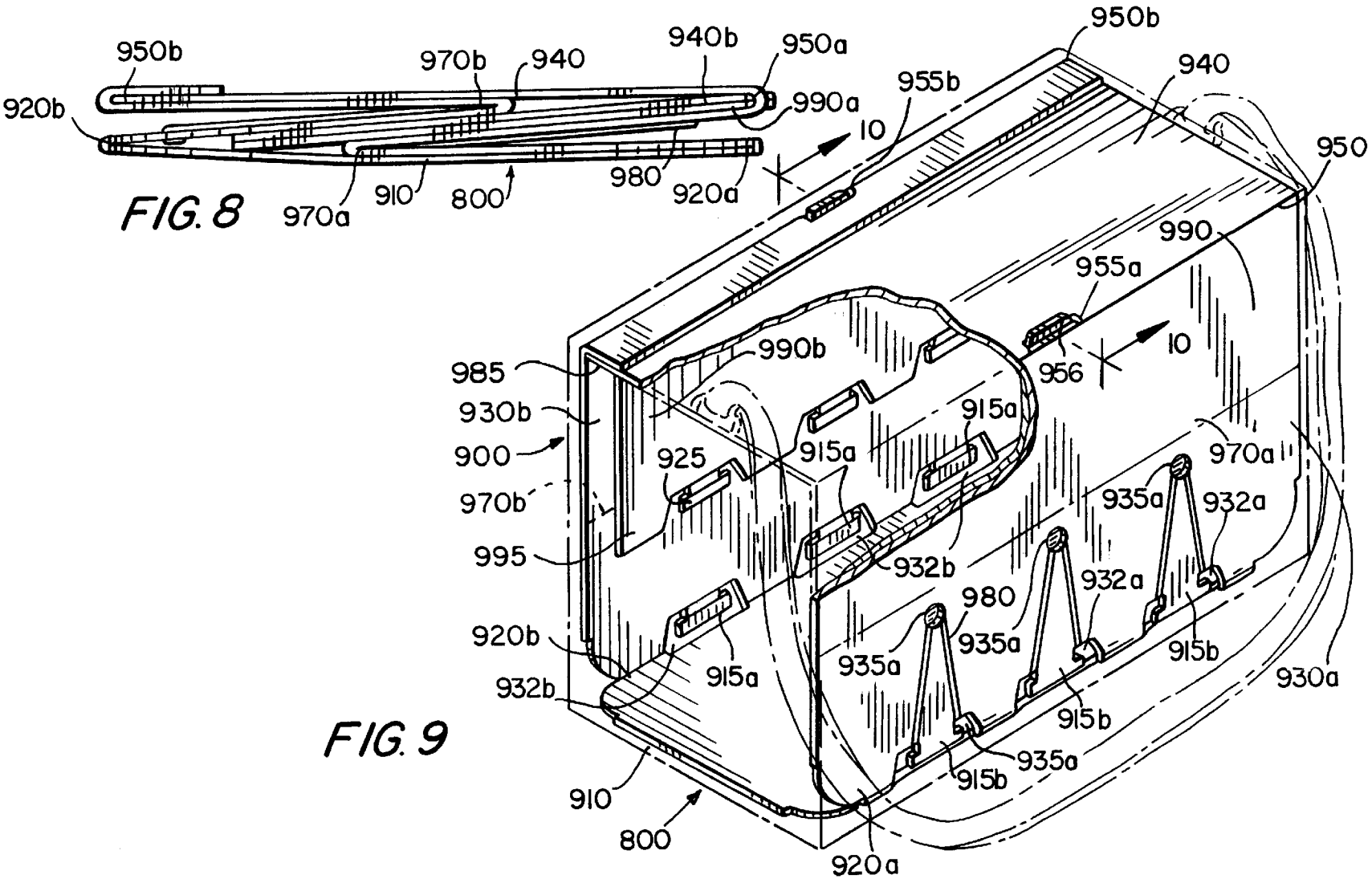
FIG. 8 is a side view of an expander in the compressed or closed position in accordance with the second embodiment of the invention.
FIG. 9 is a perspective view of a soft bag containing an expander in the open position in accordance with the second embodiment of the invention.
Figure 10:
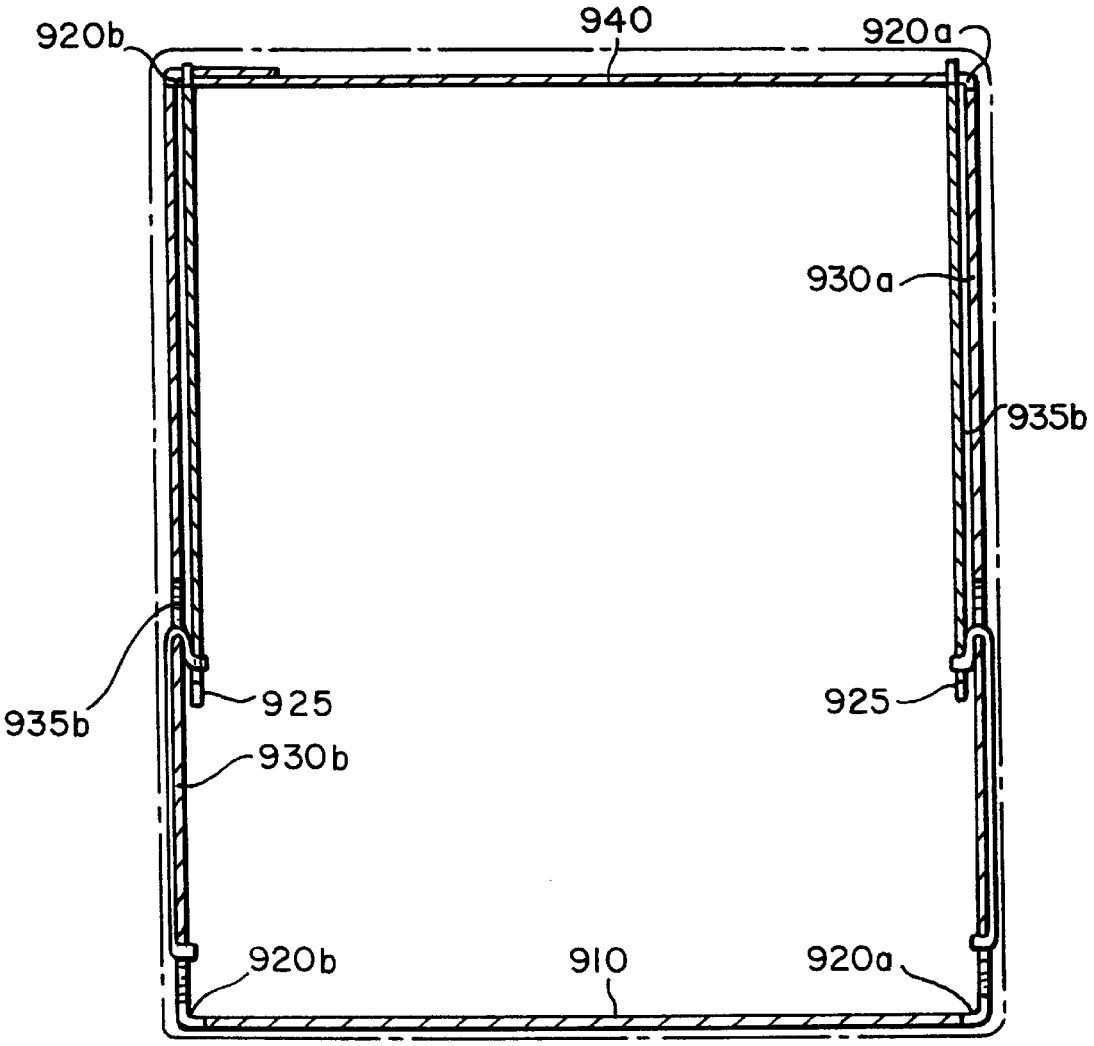
FIG. 10 is a sectional view taken along line 10—10 of FIG. 9.
Figure 11:
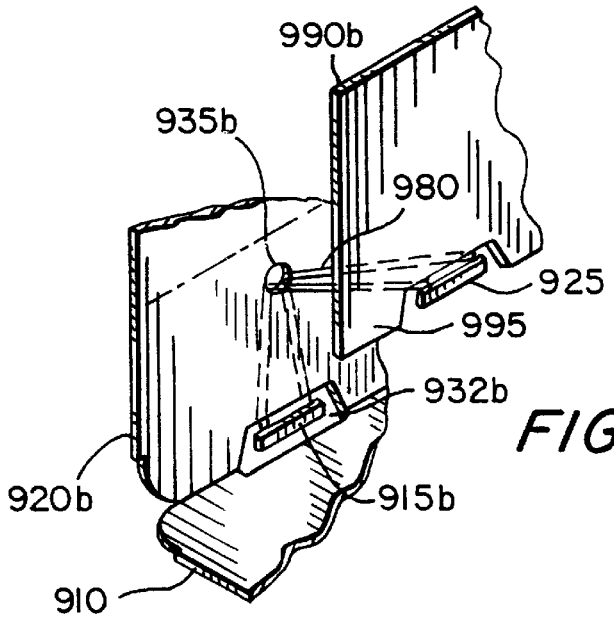
FIG. 11 is a fragmented exploded view of the expander showing the resilient member hooks and receiving holes in accordance with the second embodiment of the invention.

Each outer side panel 160 extends from a respective top panel fold line 150 to a position below each respective fold line 170. A respective resilient member 180 extends from a hook 162*a*, 162*b* through opening 166*a*, 166*b* to hook 164*a*, 164*b*. Hooks 162*a*, 162*b* are positioned closer to fold lines 150*a*, 150*b* than hooks 132*a*, 132*b* to stretch resilient member 180. Sides 160*a*, 160*b* are secured to sides 130*a*, 130*b* by tabs 168*a*, 168*b*. Resilient member 180 resiliently joins a respective one of the outer side panels 160 to a respective inner side panel 130 to bias the respective side panels 160 and 130 from a closed (collapsed) position (FIG. 8) into an open (expanded) position (FIG. 7).

Figure 3:
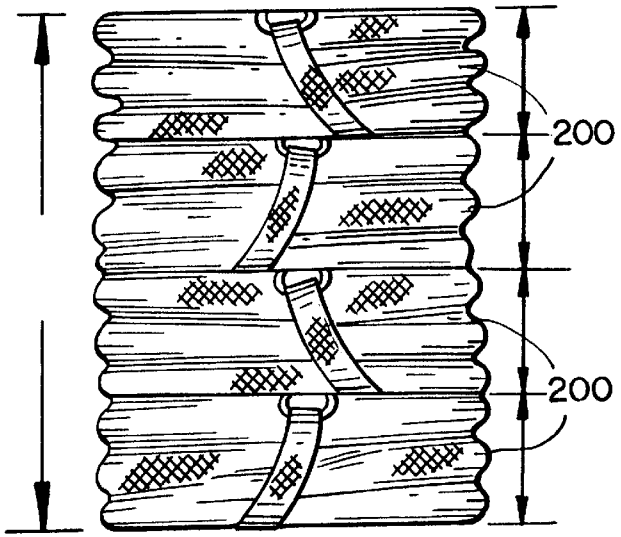
FIG. 3 is a side elevational view of four compressed soft bags as they would appear during shipping.
Figure 2:
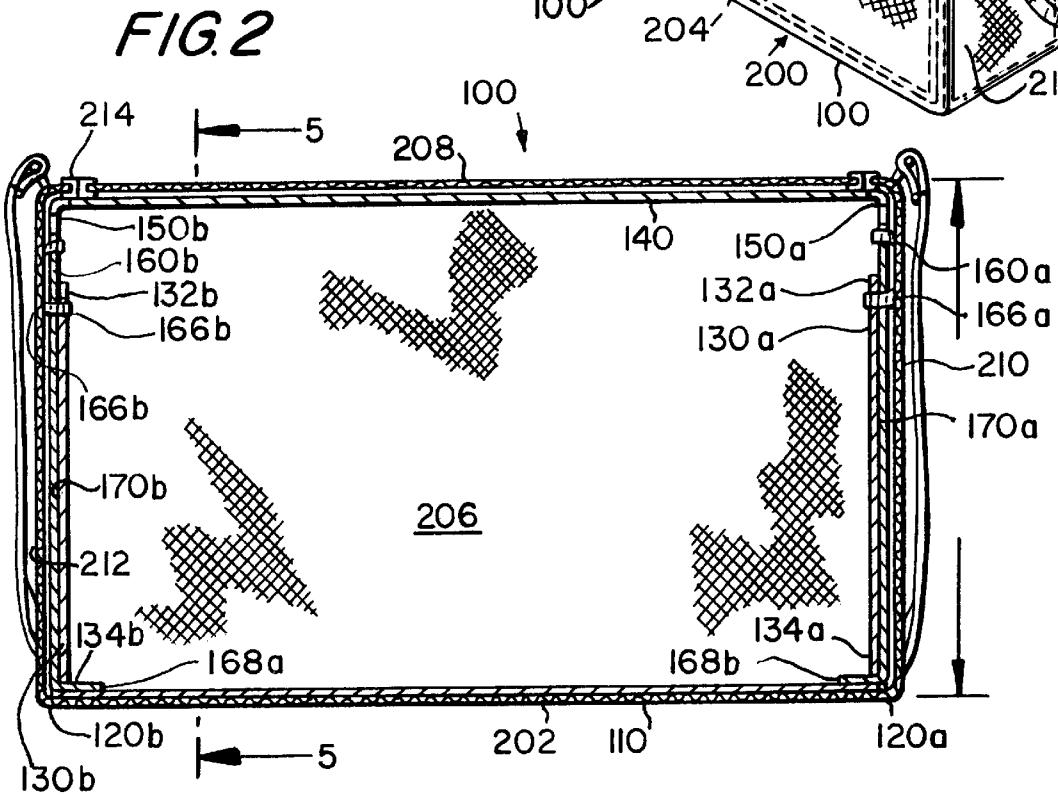
FIG. 2 is a cross-sectional view along line 2—2 of FIG. 1.
Figure 4:
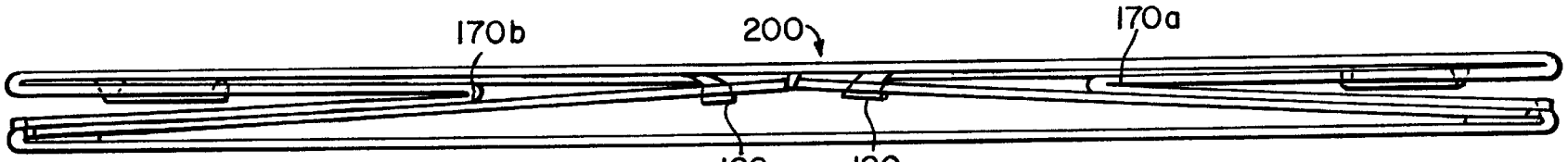
FIG. 4 is a side elevational view of an expander in the closed or compressed position in accordance with the first embodiment of the invention.
Figure 6:
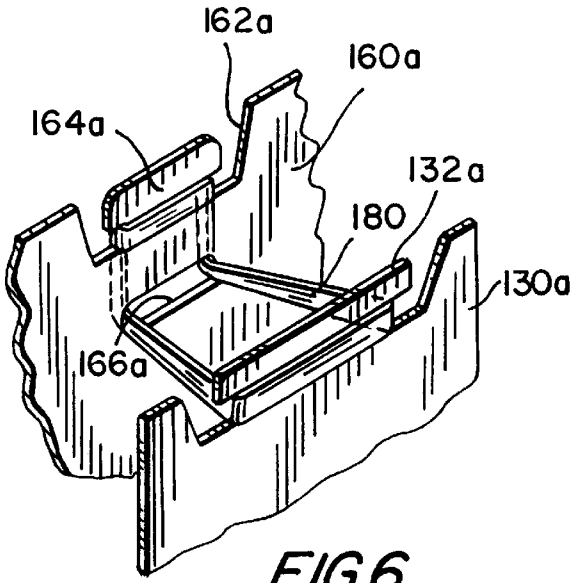
FIG. 6 is a fragmented perspective view of an expander showing the resilient member in accordance with the first embodiment of the invention.
Figure 5:
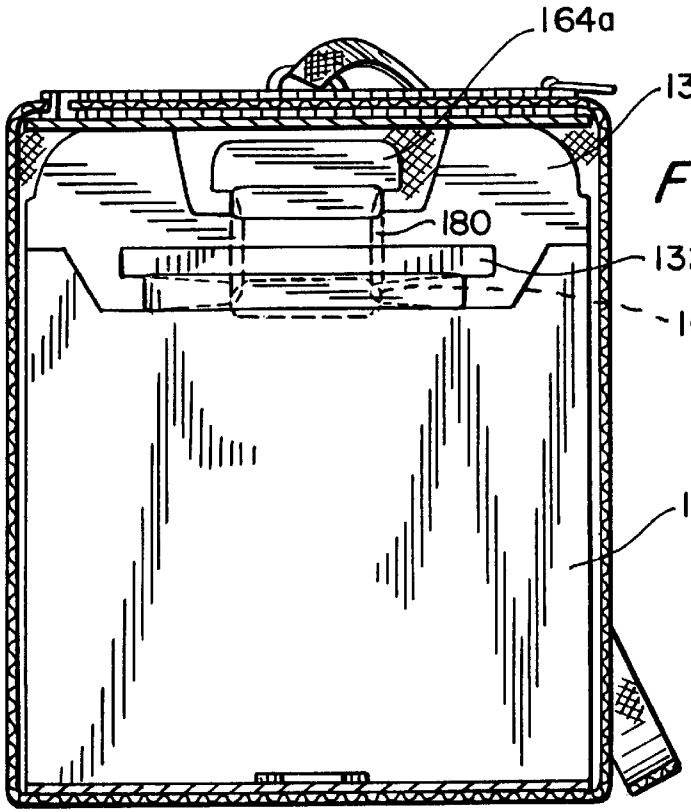
FIG. 5 is an end view of a soft bag containing an expander in accordance with the first embodiment of the invention.

The expander 100 is inserted into a soft bag in the closed position as shown in FIG. 4. When expander 100 is in the closed position as in FIG. 4 top panel 140 and bottom panel 110 lie in a parallel position to each other, while each outer side panel 160*a*, 160*b* folds against itself along fold lines 170*a*, 170*b* to form a Z between the top panel 140 and the inner side panel 130. Inner side panel 130 lays nestled between the outer side panel 160 and the bottom panel 110 in the folded position. When the expander 100 is in the closed position hooks 162*a*, 162*b* are moved away from hooks 132*a*, 132*b* so that resilient member 180 is in an expanded or stretched position. A force is applied to expander 100 to compress expander 100 and bag 200 for shipping. As shown in FIG. 3 this force may be the stacking bags 200. When the force is removed from the bag and expander unit 100, the resilient member 180 contracts forcing the inner side panel 130 against the fold line 170 of the outer side panel 160 causing panel 160 to straighten about fold line 170 thus expanding the invention into an open position such that the inner side panel 130 is biased adjacent to the outer side panel 160. The result is a fully expanded bag containing an expander 100 in the open position. The unique design of the invention gives 360° of support to the expanded bag i.e. support at multiple points fully along at least four sides.

In one particular embodiment of the invention, the top panel 140, bottom panel 110, inner side panel 130, outer side panel 160 and the top and bottom fold lines 120 and 150 are all constructed of corrugated cardboard. In the same embodiment, the invention employs an elastic rubber band as the resilient member 180.

Reference is now made to FIGS. 8 through 11 in which an expander, generally indicated as 800, constructed in accordance with another embodiment of the invention is shown.

Expander 800 is similar to expander 100, the primary difference being that expander 800 can be formed as one unit of side panels, top and bottom panels and the inclusion of separate inner panels. Expander 800 includes a bottom panel 910 having at least two bottom fold lines 920*a* and 920*b* respectively along opposite sides thereof. A first side panel 930*a* and a second panel 930*b* are affixed to said bottom panel 910 along a first fold line 920*a* and the second fold line 920*b*. Each side panel 930*a*, 930*b* is pivotable about the respective fold lines 920*a*, 920*b* and extend upwards from the bottom panel 910. A respective middle fold line 970*a*, 970*b* transverses each side panel 930*a*, 930*b* such that the respective fold lines 970*a* and 970*b* are formed substantially parallel to the bottom fold lines 920*a*, 920*b*.

A plurality of openings 932*a*, 932*b* in respective panels 930*a*, 930*b* adjacent fold lines 920*a*, 920*b*. Hooks 915*a*, 915*b* extend from respective side panels 930*a*, 930*b* into openings 932*a*, 932*b*. A plurality of openings 935*a*, 935*b* are disposed in respective side walls 930*a*, 930*b* between openings 932*a*, 932*b* and fold lines 970*a*, 970*b*. A top panel 940 has at least two top panel fold lines 950*a*, 950*b* respectively along opposite sides thereof. The top panel 940 is affixed to each side panel 930*a*, 930*b* along the respective top panel fold lines 950*a*, 950*b*. Top panel 940 is formed with a slot 955*a*, 955*b* along respective fold lines 920*a*, 920*b*.

A first inner panel 990*a* and a second inner panel 990*b* are each disposed adjacent to respective side panels 930*a*, 930*b*. Each inner panel 990*a*, 990*b* extends from a respective top panel fold line 950*a*, 950*b* to a position below each respective middle fold line 970*a*, 970*b*.

Side panels 995 are provided with a plurality of hooks 925 formed along one side thereof. A respective tab 956 extends from each panel 995 and is received within a respective slot 955*a*, 995*b* when tabs are received by slots 956*a*, 956*b* and a resilient member 980 extends from a hook 925 through holes 935 to hook 915 and resiliently joins a respective one side panel 920 to a respective inner panel 990 to bias the side panel 930*a* or 930*b* from a closed position and into an open position.

Two inner panels 990*a* and 990*b* have a top edge 985 and a bottom edge 995. Each inner panel 990*a* or 990*b* is flush with each respective side panel 930*a* or 930*b*. Each inner panel 990 extends downward from each top parallel fold line 950 such that the bottom edge 995 extends to a position below each respective fold line 970. Each inner panel 990 has three hooks by way of example, or protuberances 925 located on the lower portion of the inner panel 990 adjacent to a corresponding receiving hole or slot 935 of the side panel 930. A tab 956 extends upwards from the top panel edge 985 of each respective inner panel 990. The tab 956 is received by the slot 955 located at the junction of each side parallel fold line 950. A resilient member 980 extends upwards from each of the hooks 915 located on the side panel 930 through the receiving hole or slot 935 corresponding with each hook 915 on each side panel 930 to the corresponding hook located on the inner panel 925. Each resilient member 980 resiliently joins one of the side panels 930 to the respective inner panel 990. The bottom panel 910 side panels 930*a* and 930*b*, inner panels 990*a* and 990*b*, top panel 940 and resilient members 980 are constructed and arranged such that when the top panel 940 and the bottom panel 910 are forced towards each other, the side panel 930 folds inwardly along the fold lines 970*a*, 970*b* such that a distance from the top panel 940 to the bottom panel 910 decreases.

As with expander 100, when expander 800 is in a closed position, side panels 930*a*, 930*b* form in a shape of a Z (FIG. 8) while the inner panel 990*a* and 990*b* are nestled between the side panels and 930*a*, 930*b* and the bottom panel 910 and top panel 940. Hooks 925 are farther from hooks 915 in the closed position than in the open position, stretching elastic member 980. As in expander 100, in the absence of a compressing force, elastic member 980 will pull hooks 915 and 925 closer together causing sides 930*a*, 930*b* to straighten about fold lines 970*a*, 970*b*. Inner panels 990*a*, 990*b* prevent side panels 930*a*, 930*b* from folding upon themselves in the other direction.

One embodiment of the invention includes the bottom panel having at least two bottom fold lines along opposite sides thereof with a first inner side panel and a second inner side panel affixed to said bottom panel along the first fold line and a second fold line and each inner side panel being rotatable about the fold line to extend upwards from the bottom panel; a top panel having at least two top panel fold lines along opposite sides thereof; a first outer side panel and a second outer side panel, each outer side panel being disposed on a respective inner side panel, and a respective middle fold line transversing each outer side panel formed parallel to the bottom fold line and each outer side panel extending from a respective top panel fold line to a position below each respective fold line; a resilient member resiliently joining a respective one of the outer side panels to a respective inner side panel to bias the respective side panels from a closed position into an open position, the inner side panels being positioned adjacent to the bottom panel in the closed position and the inner side panel extending upwards from the bottom panel in the open position.

At the point of insertion of the bag expander into a soft bag, the expander is in the closed position. When the expander is in the closed position the top panel and the bottom panel lay parallel to each other while the outer side panel forms a Z between the top panel and the inner side panel and the inner side panel lays nestled between the outer side panel and the bottom panel. When the invention is in the closed position the resilient member is in an expanded position. When force is removed from the bag or expander unit, the resilient member contracts forcing the inner side panel against the fold line of the outer side panel and expanding the invention into an open position such that the inner side panel is biased adjacent to the outer side panel. The outer side panel extending beyond the fold line prevents the inner side panel from folding in the opposite direction, providing structural integrity. The unique design of the invention gives 360 degrees of support to the expanded bag.

In a preferred embodiment of the invention employs an elastic rubber band as the resilient member. In this embodiment, a hook shaped protuberance is disposed on the inner side panel. On the outer side panel another hook is disposed above the respective hook on the inner side panel and a slot is disposed on the outer side panel below both the hook on the inner side panel and the outer side panel. The resilient member extends upwards from the hook on the inner side panel through the slot disposed on the outer side panel and is joined to the corresponding hook on the outer side panel.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawing(s) shall be interpreted as illustrative and not in a limiting sense.

Particularly it is to be understood that in said claims, ingredients or compounds recited in the singular are intended to include compatible mixtures of such ingredients wherever the sense permits.

What is claimed is:

1. A soft bag expander comprising:

a bottom panel having at least a first bottom fold line and a second bottom fold line along opposite sides thereof;

a first inner side panel and a second inner side panel affixed to said bottom panel along said first bottom fold line and said second bottom fold line and each inner side panel being rotatable about each said bottom fold line to extend away from the bottom panel;

a top panel having at least a first top panel fold line and a second top panel fold line along opposite sides thereof;

a first outer side panel and a second outer side panel, each outer side panel being disposed on a respective inner side panel, a respective inner side fold line transversing each outer side panel formed parallel to a respective one of the first bottom fold line and second bottom fold line, each outer side panel extending from a respective top panel fold line to a position beyond each respective inner side panel;

a resilient member coupled to a respective one of the outer side panels and coupled to a respective inner side panel to resiliently bias the respective side panels from a closed position into an open position, the inner side panels being positioned adjacent to the bottom panel in the closed position and the inner side panel extending away from the bottom panel in the open position.

2. The soft bag expander of claim 1, wherein the top panel, bottom panel, outer side panels and inner side panels are all nested when the expander is in the closed position.

3. The soft bag expander of claim 1, wherein the top panel, bottom panel, outer side panels and inner side panels form a Z shape when a force is exerted on the top panel.

4. The soft bag expander of claim 1, wherein the top panel, bottom panel, outer side panels and inner side panels are constructed of corrugated cardboard.

5. The soft bag expander of claim 1, wherein the resilient member is an elastic rubber band.

6. A soft bag expander comprising:

a bottom panel having at least a first bottom fold line and a second bottom fold line along opposite sides thereof;

a first side panel and a second side panel affixed to said bottom panel along a first bottom panel fold line and a second bottom panel fold line and each side panel being pivotable about the respective bottom panel fold line to extend away from the bottom panel, a respective side panel fold line traversing each side panel extending substantially parallel to each respective bottom fold line;

a top panel having at least a first top panel fold line and a second top panel fold line along opposite sides thereof, the top panel being affixed to each side panel along a respective top panel fold line;

a first inner panel and a second inner panel, each inner panel being disposed on a respective side panel, each inner panel extending from a respective one of the first top panel fold line and second panel fold line to a position below each respective side panel fold line;

a resilient member coupled to a respective one of the outer side panels and coupled to a respective inner side panel to resiliently bias the side panels from a closed position into an open position, the side panels being positioned adjacent to the bottom panel in the closed position and the side panel extending away from the bottom panel in the open position.

7. The soft bag expander of claim 6, wherein the top panel, bottom panel, outer side panels and inner side panels are all nested when the expander is in the closed position.

8. The soft bag expander of claim 6, wherein the top panel, bottom panel, outer side panels and inner side panels form a Z shape when a force is exerted on the top panel.

9. The soft bag expander of claim 6, wherein the top panel, bottom panel, outer side panels and inner side panels are constructed of corrugated cardboard.

10. The soft bag expander of claim 6, wherein the resilient member is an elastic rubber band.

11. A soft bag expander comprising;

a bottom panel having two parallel fold lines on opposite sides thereof;

two side panels extending upwards from the two parallel fold lines of the bottom panel, each side panel having hooks thereon, located on a lower portion of the panel, receiving holes formed therein and above a corresponding hook, a fold line transversing each side panel formed above the receiving holes and parallel to the parallel fold lines and a top fold line;

a top panel having two parallel top panel fold lines on opposite sides thereof, respective side panel being affixed to said top panel along a respective fold line forming a junction, each fold line having a slot formed therein;

a first and second inner panels, each inner panel being flush with a respective side panel, a respective inner panel extending from each top panel fold line beyond each respective fold line, each inner panel having three hooks located on a lower portion of the panel adjacent to a corresponding receiving hole of the side panel, and a tab extending upwards from the top fold line of each respective inner panel, the tab being received by the slot located at the junction of each side parallel panel fold line and the top panel fold line;

a resilient member extending upwards from each of the hooks located on one of the side panels, through the receiving hole corresponding with each hook on the side panel to the corresponding hook located on the inner panel, each resilient member resiliently joining one of the side panels to the respective inner panel; and the bottom panel, side panels, inner panels, top panel and resilient members are constructed and arranged such that when the top and bottom panels are forced toward each other, the side panel folds inwardly on the fold line such that the distance from the top panel to the bottom panel decreases.

12. The soft bag expander of claim 11, wherein the top panel, bottom panel, outer side panels and inner side panels are all nested when the expander is in the closed position.

13. The soft bag expander of claim 11, wherein the top panel, bottom panel, outer side panels and inner side panels form a Z shape when a force is exerted on the top panel.

14. The soft bag expander of claim 11, wherein the top panel, bottom panel, outer side panels and inner side panels when in the open position, support the soft bag in which it is inserted at more than one position.

15. The soft bag expander of claim 11, wherein the top panel, bottom panel, outer side panels and inner side panels are constructed of corrugated cardboard.

16. The soft bag expander of claim 11, wherein the resilient member is an elastic rubber band.

* * * * *